US006146039A

United States Patent [19]

Pool et al.

[11] Patent Number: 6,146,039

[45] Date of Patent: Nov. 14, 2000

[54] MUD BOX FOR JOINT COMPOUND APPLICATION

[75] Inventors: Dan B. Pool; Toby Edwards; David F. Kreitzer, all of Phoenix, Ariz.

[73] Assignee: Equity Earnings Corp, Phoenix, Ariz.

[21] Appl. No.: 09/356,588

[22] Filed: Jul. 19, 1999

[51] Int. Cl.[7] ..... E04F 21/06

[52] U.S. Cl. ..... 401/48; 401/5; 401/171; 425/87

[58] Field of Search ..... 401/5, 48, 137–139, 401/160, 166–168, 171, 263, 264; 425/87

[56] References Cited

U.S. PATENT DOCUMENTS

| | | | |
|---|---|---|---|
| 2,809,513 | 10/1957 | Ames | 401/171 |
| 2,824,442 | 2/1958 | Ames | 401/171 |
| 2,889,699 | 6/1959 | Ames | 401/48 |
| 2,984,857 | 5/1961 | Ames | 401/5 |
| 3,103,033 | 9/1963 | Ames | 401/171 |
| 3,116,511 | 1/1964 | Hoveland | 401/171 |
| 3,451,757 | 6/1969 | Stroud et al. | 401/5 |
| 4,516,868 | 5/1985 | Molnar | 401/5 |
| 5,143,264 | 9/1992 | MacMillan | 401/48 |
| 5,670,182 | 9/1997 | Mower | 401/48 |
| 5,814,351 | 9/1998 | Mower | 401/48 |

*Primary Examiner*—Charles R. Eloshway

*Attorney, Agent, or Firm*—Parsons & Goltry; Robert A. Parsons; Michael W. Goltry

[57] ABSTRACT

A mud box includes a bottom surface with an outlet orifice, sides, a cover pivotally attached along one edge, and a handle attached to the cover for positioning the box on a surface and applying extruding pressure to the cover for ejecting material through the orifice. A spring assembly is attached to the box and connected to apply extruding pressure to the cover. A primary lock is coupled to the spring assembly and the box, the primary lock has a locked position in which the spring assembly is prevented from applying extruding pressure to the cover and an unlocked position in which the spring assembly applies extruding pressure to the cover. The primary lock is activated by a wheel assembly which moves it into the locked position when the box and wheel assembly are disengaged from a surface and which moves it into the unlocked position when the wheel assembly and box are engaged with a surface.

22 Claims, 9 Drawing Sheets

MUD BOX FOR JOINT COMPOUND APPLICATION

FIELD OF THE INVENTION

This invention relates to mud boxes for drywall joint compound application.

More particularly, the present invention relates to mud boxes which automatically extrude or expel joint compound.

BACKGROUND OF THE INVENTION

Boxes which are filled with joint compound for application to drywall joints and the like, hereinafter referred to as a "mud box", are well known in the art. Generally the mud box is constructed with an orifice in the bottom surface which operates as an outlet through which the joint compound is extruded or expelled. A cover on the mud box can be opened to allow the mud box to be filled with joint compound and when closed has springs attached to bias it toward the opened position. A handle affixed to the cover allows an operator to apply inward pressure on the cover to force the joint compound through the outlet slot and onto a joint or the like. The extruded joint compound is then spread and smoothed by a blade-like projection on the underside of the mud box, as the mud box is moved along a joint.

The problem with prior art mud boxes is that the springs attached to the cover are affixed so as to bias the cover toward the open position to aid in opening and filling the mud box and to ensure that joint compound is not extruded or ejected from the box continuously, i.e. no joint compound should be extruded when the operator releases pressure on the handle or cover of the mud box. Because the springs on the cover bias the cover toward the open position, the operator must apply sufficient pressure on the handle and, hence, the cover to overcome the spring bias and to eject or extrude joint compound from the outlet of the mud box. Since mud boxes are generally used by professionals who spend complete days applying joint compound to drywall and the like, the additional spring tension that must be overcome can become a great deal of extra work for the operator. To avoid all the additional work caused by the springs on the cover, many operators simply detach and/or remove the springs. However, without the springs the cover is simply pivotally attached along one edge and the entire mud box is more ungainly to use and to fill.

It would be highly advantageous, therefore, to remedy the foregoing and other deficiencies inherent in the prior art.

Accordingly, it is an object of the present invention to provide a new and improved mud box for use in applying joint compound to drywall joints and the like.

Another object of the invention is to provide a new and improved mud box which is easier to use.

And another object of the invention is to provide a new and improved mud box which greatly reduces back and arm fatigue.

Still another object of the invention is to provide a new and improved mud box which is inexpensive to manufacture.

Still another object of the present invention is to provide a new and improved mud box which applies joint compound in a more even film.

SUMMARY OF THE INVENTION

Briefly, to achieve the desired objects of the instant invention in accordance with a preferred embodiment thereof, provided is a mud box including a bottom surface with an outlet orifice, sides, a cover pivotally attached along one edge, and a handle attached to the cover for positioning the box on a surface and applying extruding pressure to the cover for ejecting material through the orifice. A spring assembly is attached to the box and connected to apply extruding pressure to the cover. A primary lock is coupled to the spring assembly and the box, the primary lock has a locked position in which the spring assembly is prevented from applying extruding pressure to the cover and an unlocked position in which the spring assembly applies extruding pressure to the cover. The primary lock is activated by a wheel assembly which moves it into the locked position when the box and wheel assembly are disengaged from a surface and which moves it into the unlocked position when the wheel assembly and box are engaged with a surface.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
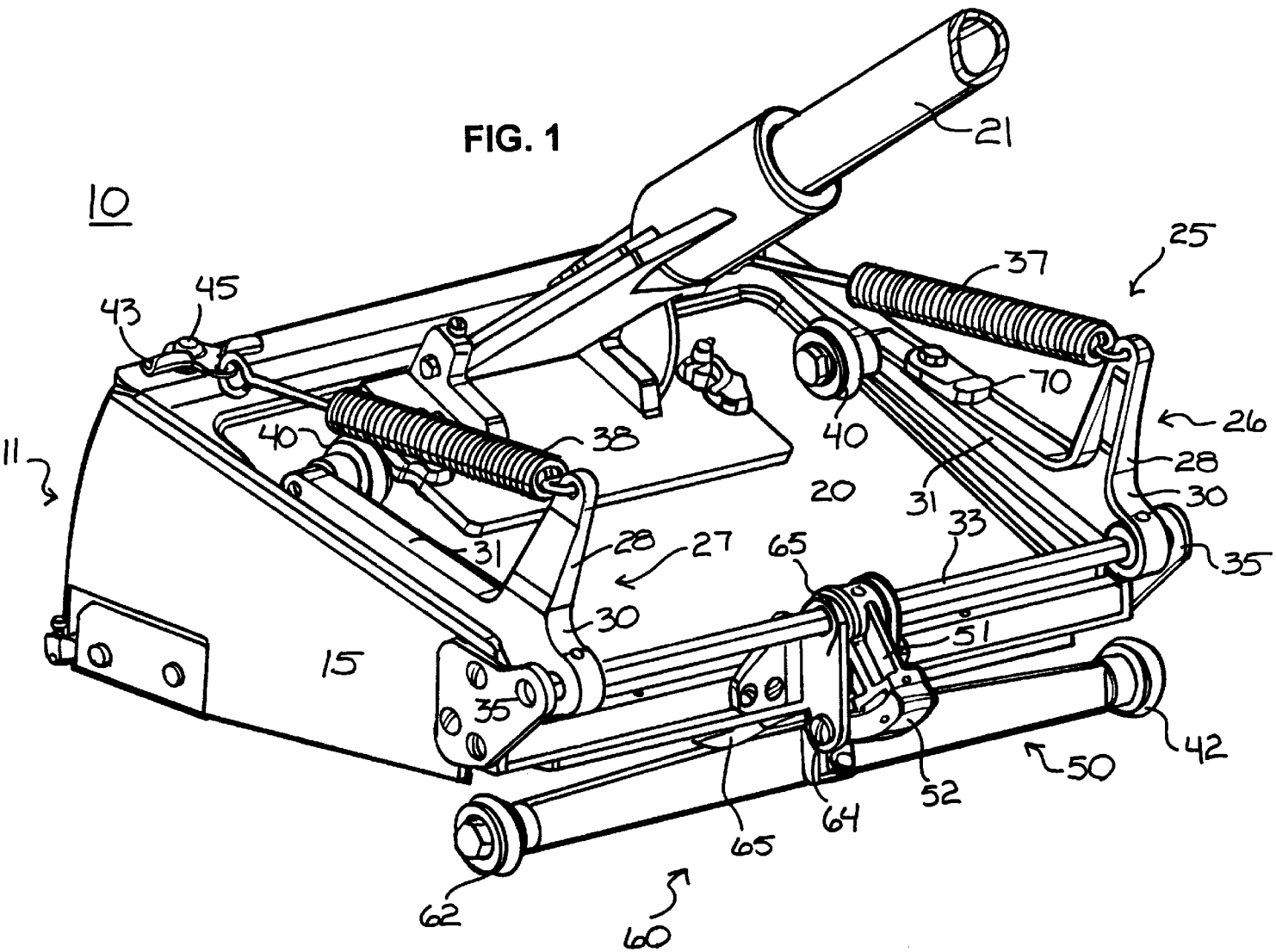
FIG. 1 is an isometric view of a mud box in accordance with the present invention, in this illustration the mud box is shown full joint compound.
Figure 3:
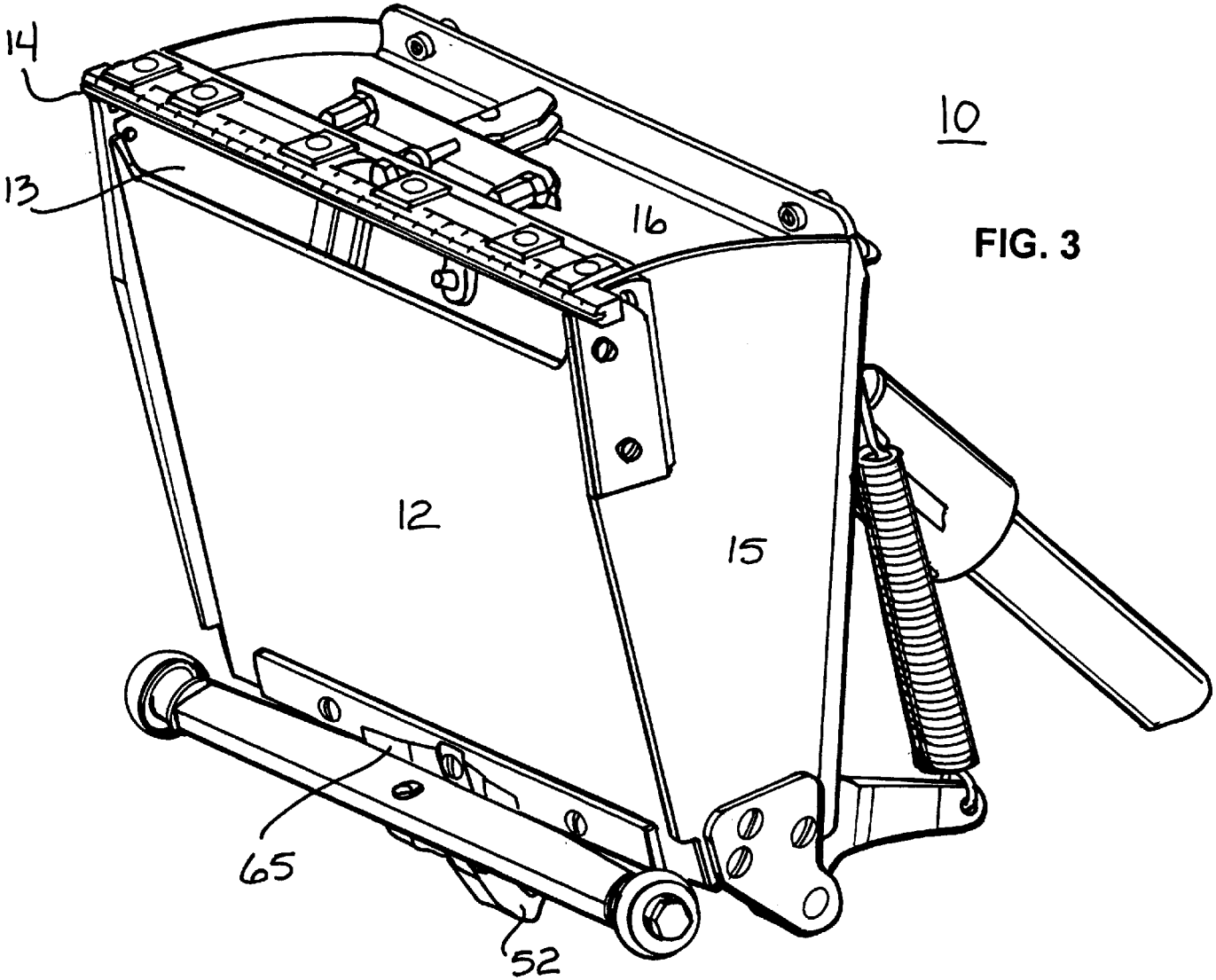
FIG. 3 is an isometric view showing the under side of the mud box illustrated in FIG. 1.
Figure 4:
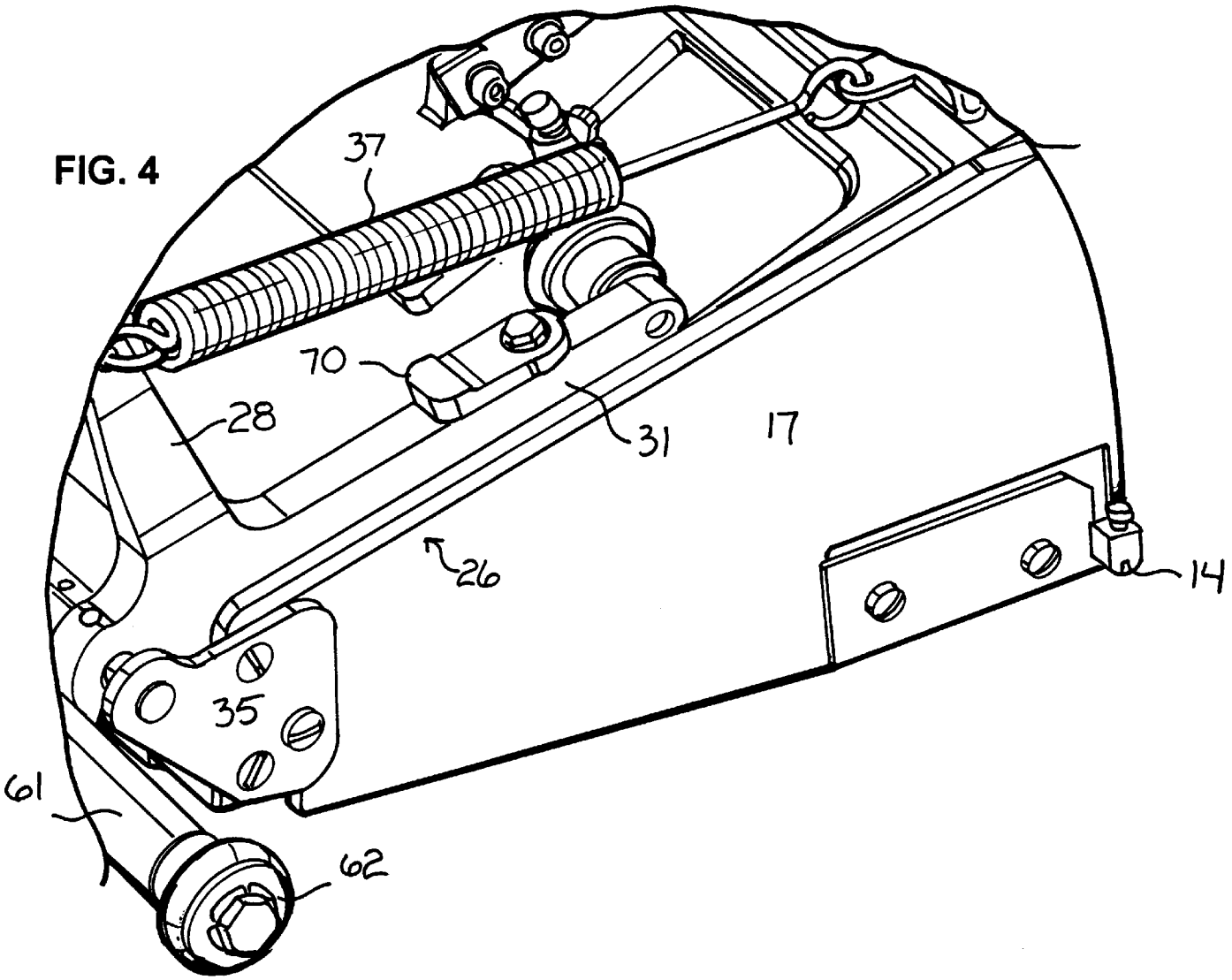
FIG. 4 is an enlarged isometric view, portions thereof broken away, illustrating a locking component in more detail.

Turning now to the drawings in which like reference characters indicate corresponding elements throughout the several views, attention is first directed to FIG. 1 which illustrates a mud box 10 in accordance with the present invention. Mud box 10, which refers to the entire assembly, includes a box 11 with a bottom surface 12 (see FIG. 3) having an outlet orifice 13 through which joint compound or the like is extruded or ejected from box 11 under pressure. The extruded joint compound is then spread and smoothed by a squeegee or blade-like projection 14 on the underside of box 11, as mud box 10 is moved along a joint or wallboard surface. Box 11 further includes a left side 15, a front side or end 16, and a right side 17 (see FIG. 4). In addition to box 11, mud box 10 includes a cover 20 pivotally attached along the rear edge of box 11, and a handle 21 attached to cover 20 for positioning mud box 10 on a surface and applying extruding pressure to cover 20 for ejecting material through orifice 12.

A spring assembly 25 is attached to box 11 and connected to apply extruding pressure to cover 20. Assembly 25 includes first and second pressure members 26 and 27. Each pressure member 26 and 27 is generally L-shaped and includes a first arm 28 extending outwardly from a pivot axis 30 and a second arm 31 extending outwardly from pivot axis 30 at an angle to arm 31 and bearing against cover 20 to apply extruding pressure to cover 20. Pressure members 26 and 27 are pivotally mounted on a pressure member mounting axle 33, which is rotatably mounted on box 10 by means of bearing plates 35 at each end of axle 33. One end of a tension spring 37 is attached to arm 28 of pressure member 26 and the other end is attached to front side 16 of box 11. One end of a tension spring 38 is attached to arm 28 of pressure member 27 and the other end is attached to front side 16 of box 11. Thus, it can be seen that pressure members 26 and 27 are mounted so that arms 31 bear against the cover and apply extruding pressure to cover 20 in response to tension of tension springs 37 and 38. A roller 40 is rotatably mounted adjacent the end of each arm 31 of pressure members 26 and 27 so as to bear against cover 20 (rather than arms 31 bearing directly on cover 20) and reduce friction.

Figure 9:
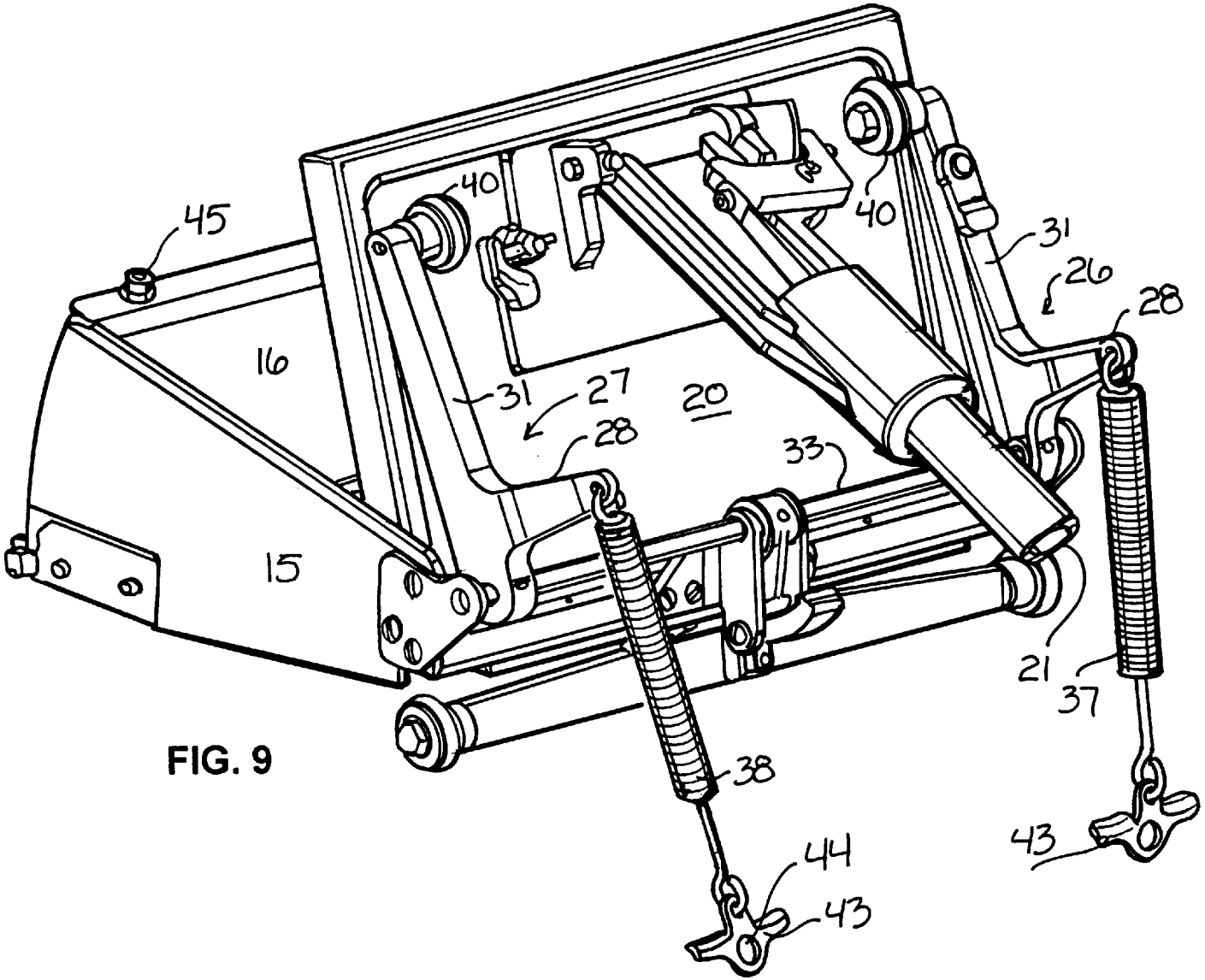
FIG. 9 an isometric view of the mud box of FIG. 1 in an opened or fill position.

As can be seen by referring to FIG. 9, the ends of tension springs 37 and 38, which are connected to front side 16 of box 11, are removably connected by means of clips 43. Each clip 43 includes a central opening 44 which is slightly elongated and key-hole shaped to fit over the end of a bolt 45 threadedly engaged in front end 16 of box 11. Once clip 43 is engaged over bolt 45, the tension of the attached spring holds it firmly connected. Clips 43 are constructed to engage the ends of tension springs 37 and 38 and to be handily positioned over bolts 45 or removed therefrom. With tension springs 37 and 38 disconnected, as illustrated in FIG. 9, and cover 20 open, mud box 10 is ready for cleaning after a completed operation or for refilling, as is necessary.

Referring again to FIG. 1, a primary lock, generally designated 50, is coupled to pressure members 26 and 27 and box 20. Primary lock 50 has a locked position (illustrated specifically in FIG. 6) in which pressure members 26 and 27 are prevented from applying extruding pressure to cover 20 and an unlocked position (illustrated specifically in FIG. 7) in which pressure members 26 and 27 apply extruding pressure to cover 20. Primary lock 50 includes a ratchet 51 attached to axle 33 for rotary movement therewith and a pawl 52 pivotally affixed to box 20 for engaging ratchet 51. Pawl 52 is attached to box 20 by means of a wheel assembly, generally designated 60. When pawl 52 is engaged with ratchet 51, primary lock 50 is in the locked position and pressure members 26 and 27 are prevented from applying extruding pressure to cover 20. When pawl 52 is disengaged from ratchet 51, primary lock 50 is in the unlocked position and pressure members 26 and 27 automatically apply extruding pressure to cover 20.

Wheel assembly 60 includes an elongated wheel mounting axle 61 having a wheel 62 rotatably affixed to each end and positioned generally outwardly from sides 15 and 17 of box 20. Axle 61 is pivotally attached to box 11 by means of a pivot pin 64 engaged in a bearing plate 65 which is fixedly attached to box 11. Pivot pin 64 pivotally mounts axle 61 with wheels 62 generally extending below bottom surface 12 of box 20 in a disengaged orientation (i.e. not engaged with a surface) and pivotal upwardly generally into a plane with bottom surface 12 in an engaged orientation (i.e. engaged with a surface). Pawl 52 is attached to axle 61 for pivotal movement therewith and is mounted to engage ratchet 51 (i.e. axle 61 rotates counterclockwise about pivot pin 64 in FIG. 1) when wheels 62 are in the disengaged position, that is not in contact with a surface. As illustrated specifically in FIG. 6, when wheels 62 are disengaged from a surface and pawl 52 engages ratchet 51, primary lock 50 is in the locked orientation and pressure members 26 and 27 are prevented from applying extruding pressure to cover 20. Further, as illustrated specifically in FIG. 7, when wheels 62 are engaged with a surface and pawl 52 disengages ratchet 51, primary lock 50 is in the unlocked orientation and pressure members 26 and 27 apply extruding pressure to cover 20. Wheel assembly 60 further includes a leaf spring 65 attached to the under side of box 20 and bearing on wheel mounting axle 61 to bias axle 61 and pawl 51 into the locked position whenever wheel assembly 60 is in the disengaged orientation.

Figure 2:
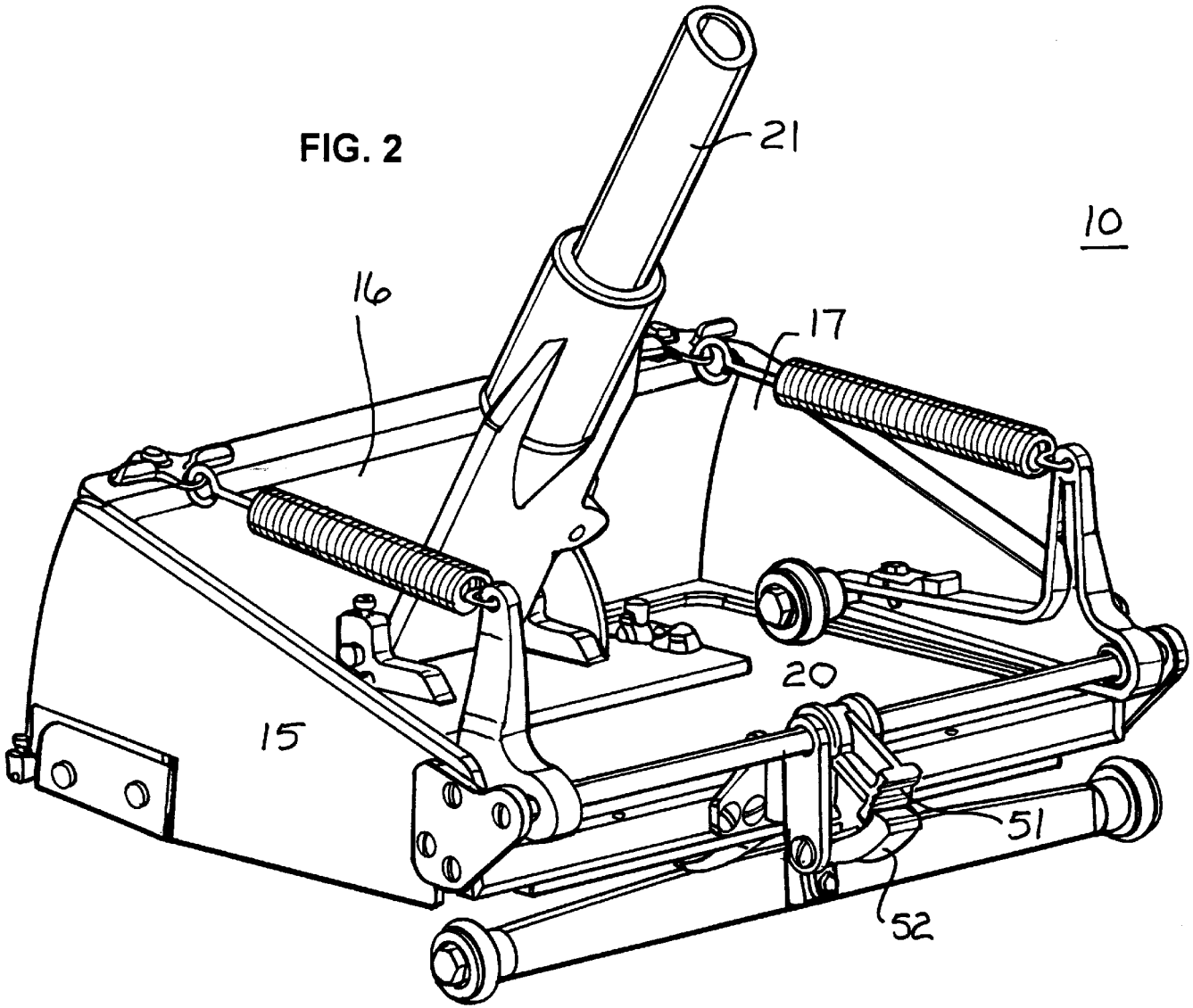
FIG. 2 is a view similar to FIG. 1 with the mud box empty.
Figure 6:
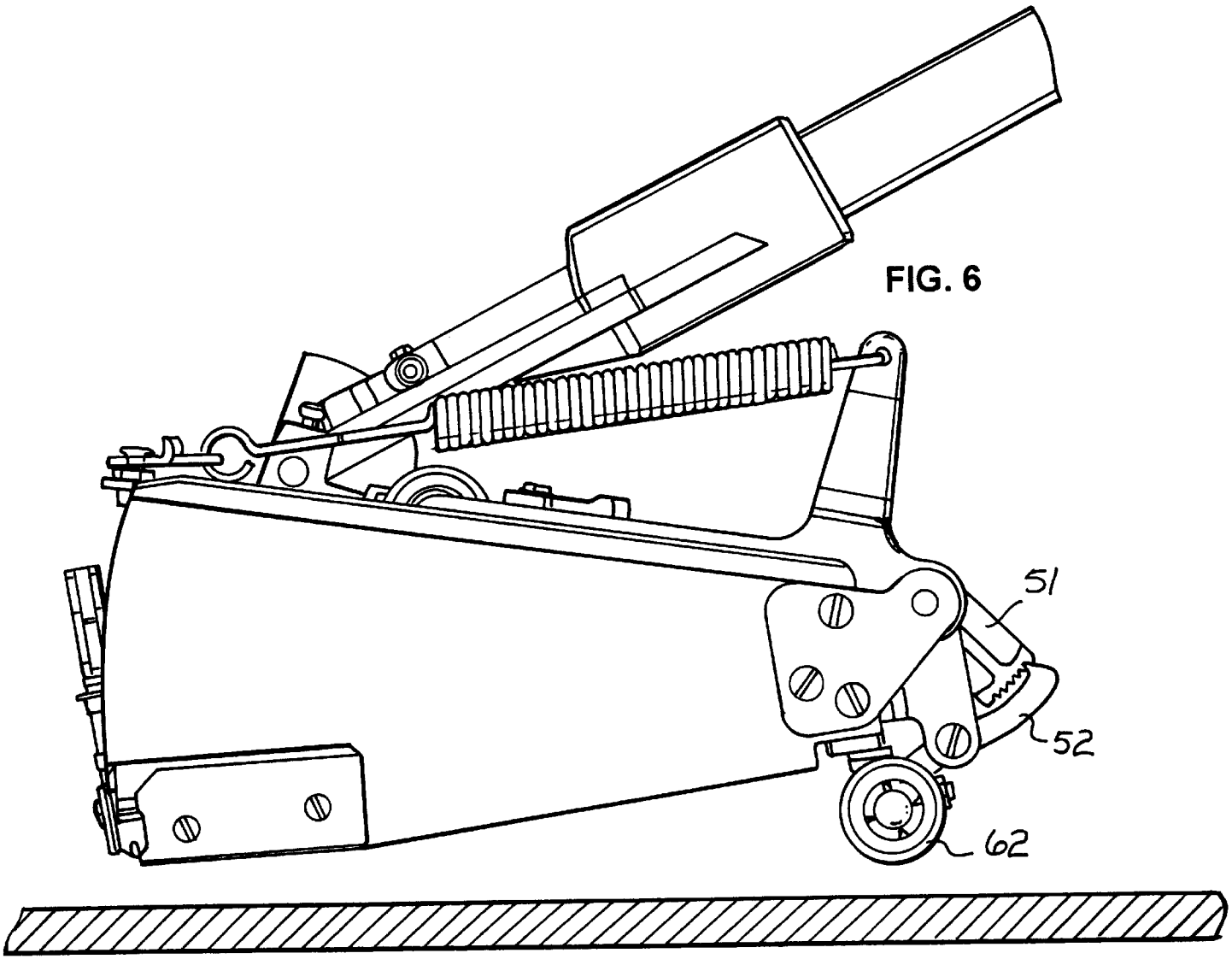
FIG. 6 is a view in side elevation of the mud box of FIG. 1 disengaged from a wall.
Figure 7:
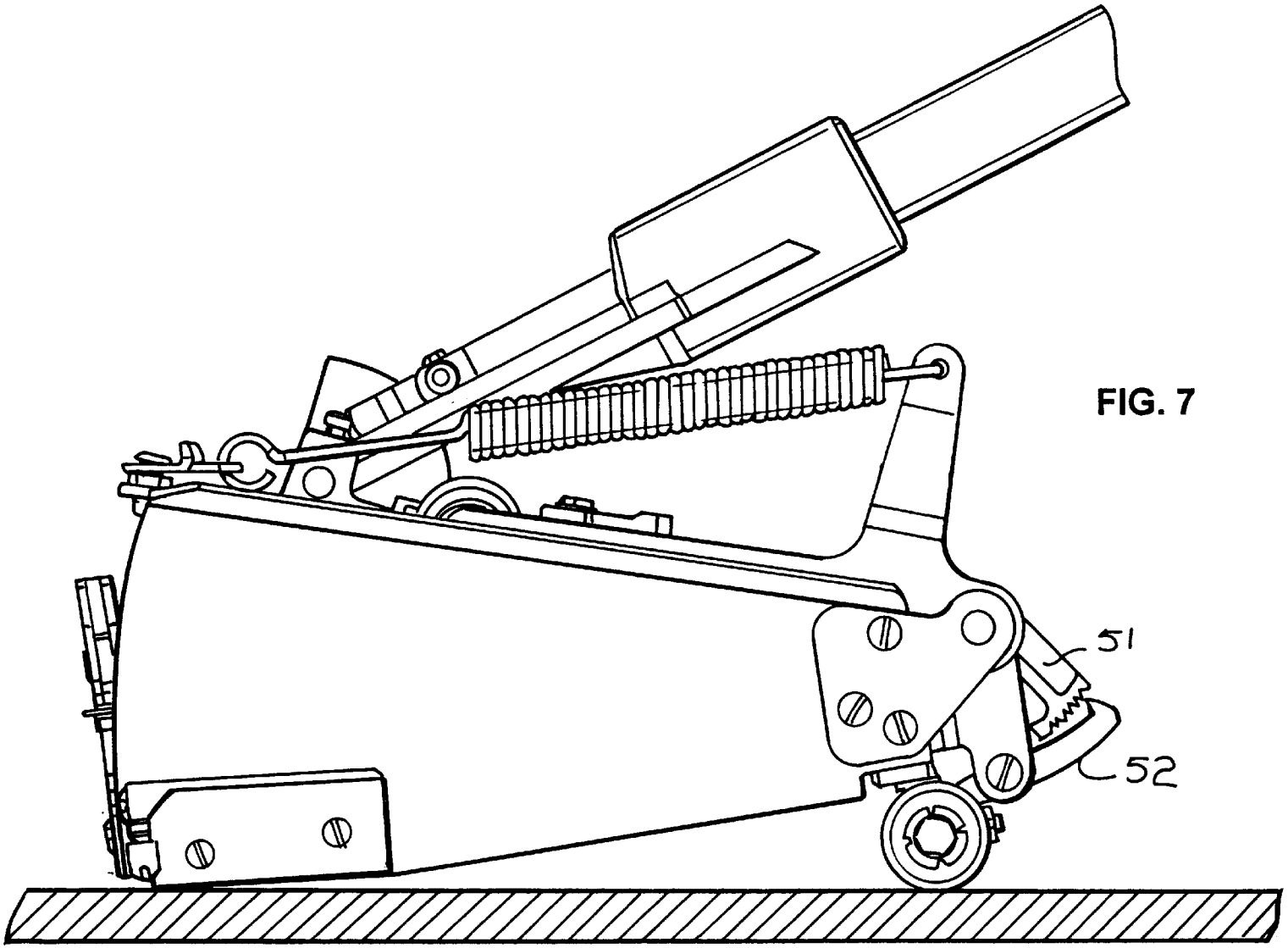
FIGS. 7 and 8 are side elevational views, similar to FIG. 6, of the mud box engaged with a wall and in operation.
Figure 8:
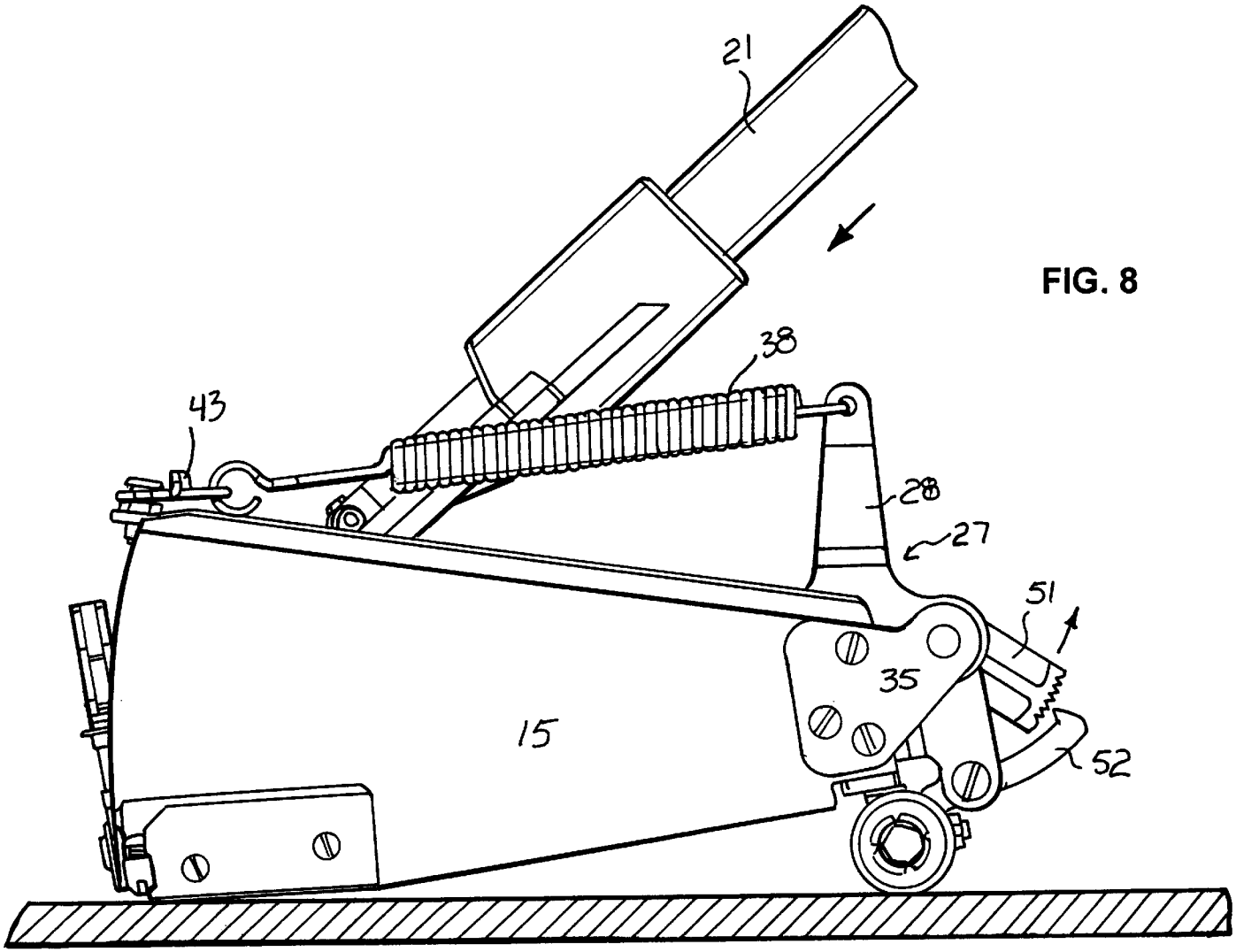

Thus, tension springs 37 and 38 can be detached from box 11 and cover 20 lifted, as illustrated in FIG. 9, for cleaning and filling with joint compound. Once box 11 is filled with joint compound cover 20 is positioned over box 11 and tension springs 37 and 38 are reattached, as illustrated in FIG. 1. Mud box 10 is engaged with a surface to properly cover a joint in drywall or the like and a combination of tension from tension springs 37 and 38 and pressure on handle 21 slowly extrudes the joint compound from box 11 until all of the joint compound is used, as illustrated in FIG. 2. Referring to FIG. 6, as the job proceeds each time mud box 10 is disengaged from the surface wheel assembly 60 causes primary lock 50 to prevent pressure members 26 and 27 and tension springs 37 and 38 from applying pressure to cover 20 so that no joint compound is extruded when mud box 10 is disengaged from the surface. Each time mud box 10 is again engaged with the surface, as illustrated in FIG. 7, wheel assembly 60 unlocks primary lock 50 and pressure members 26 and 27 and tension springs 37 and 38 automatically apply pressure to cover 20 so that joint compound is extruded. Further, as the joint compound is extruded from box 11 cover 20 slowly advances or sinks into box 10 and pawl 52 engages ratchet 51 further along its extent, as illustrated in FIG. 8.

Figure 5:
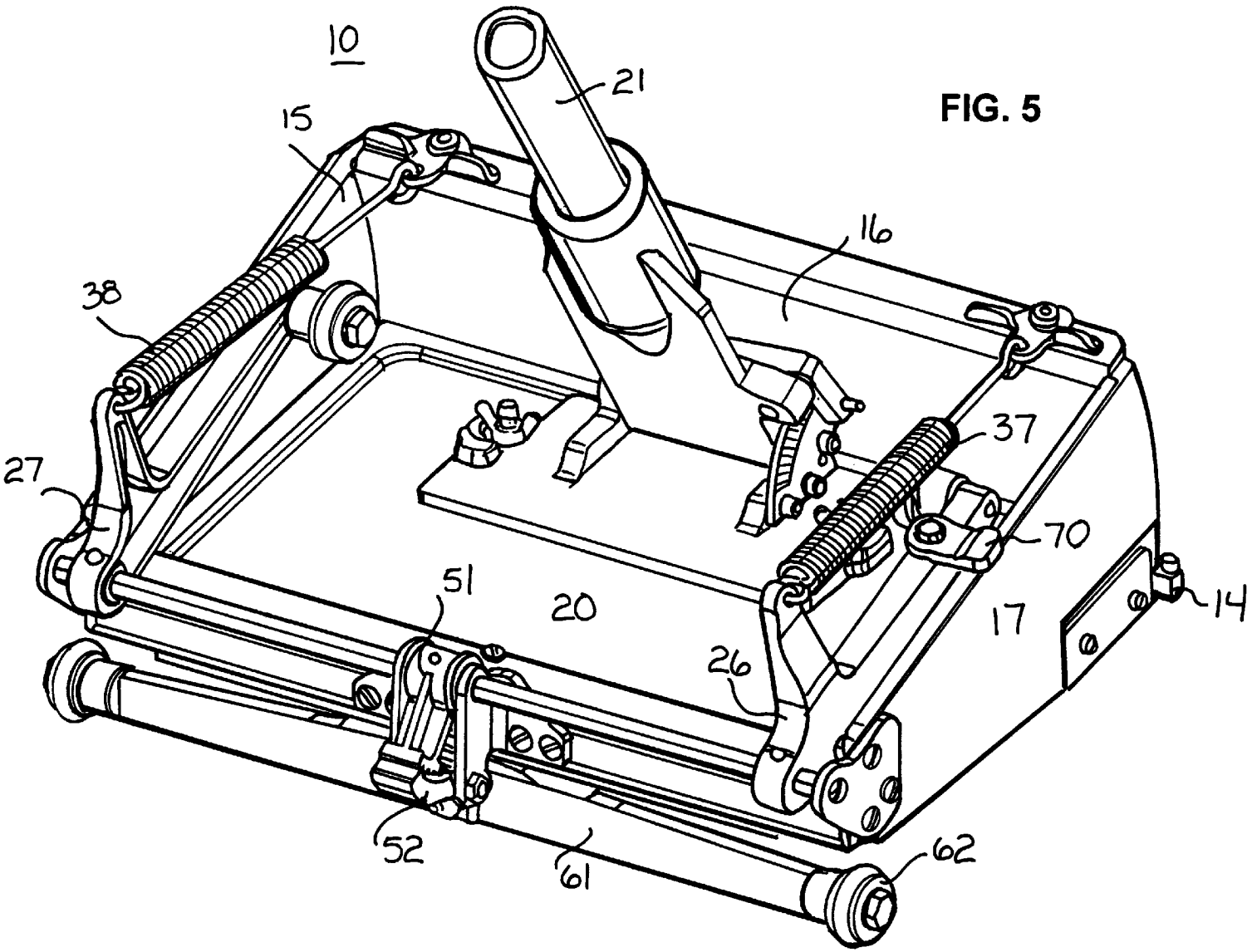
FIG. 5 is an isometric view illustrating the locking component of FIG. 4 in an engaged position.

In some applications, automatic extrusion of the joint compound from box 11 may not be desirable. For these applications, mud box 10 is provided with a secondary lock 70 pivotally attached to the upper surface of arm 31 of pressure member 26. Secondary lock 70 is positioned so as to have an unlocked or disengaged position (see FIG. 4) in which it lies parallel to arm 31 and has no effect on the operation. Secondary lock 70 can be pivoted or rotated so as to bear against an upper edge of side 17 of box 11 (see FIG. 5) and to thereby prevent or lock pressure members 26 and 27 from pressing against cover 20. Thus, the automatic extruding pressure of springs 37 and 38 is locked or prevented from occurring so that only pressure applied to handle 21 provides the extruding pressure.

Thus, a new and improved mud box for use in applying joint compound to drywall joints and the like is disclosed. The new and improved mud box is easier to use and greatly reduces back and arm fatigue because extruding pressure is automatically applied so that the operator not only does not have to overcome the spring tension as in prior art devices, but the springs provide automatic extruding pressure to aid the operator and reduce the work he must do. Also, the new and improved mud box is inexpensive to manufacture and sell so that it is very cost efficient.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A mud box comprising:

a box including a bottom surface with an outlet orifice, sides, a cover pivotally attached along one edge of the box, and a handle attached to the cover for positioning the box on a surface and applying extruding pressure to the cover for ejecting material through the orifice;

a spring assembly attached to the box and arranged to apply extruding pressure to the cover; and a primary lock coupled to the spring assembly and the box, the primary lock having a locked position in which the spring assembly is prevented from applying extruding pressure to the cover and an unlocked position in which the spring assembly applies extruding pressure to the cover.

2. A mud box as claimed in claim 1 wherein the spring assembly includes a tension spring having one end attached to the box and another end attached to a pressure member pivotally mounted on the box, the pressure member being mounted so as to bear against the cover and apply extruding pressure to the cover in response to tension of the tension spring.

3. A mud box as claimed in claim 2 wherein the spring assembly includes a plurality of springs.

4. A mud box as claimed in claim 2 wherein the pressure member pivotally mounted on the box includes a first arm extending outwardly from a pivot axis with the another end of the tension spring attached and a second arm extending outwardly from the pivot axis at an angle to the first arm and bearing against the cover.

5. A mud box as claimed in claim 4 wherein the second arm includes a roller attached thereto which bears against the cover.

6. A mud box as claimed in claim 1 wherein the primary lock is activated by a wheel assembly which moves the primary lock into the locked position when the box and wheel assembly are disengaged from a surface and which moves the primary lock into the unlocked position when the wheel assembly and box are engaged with a surface.

7. A mud box as claimed in claim 4 wherein the pressure member is mounted on an axle and the primary lock includes a ratchet attached to the axle for rotary movement with the axle and a pawl pivotally affixed to the box for engaging the ratchet and preventing rotation thereof in the locked position and disengaging the ratchet and allowing rotation thereof in the unlocked position.

8. A mud box as claimed in claim 7 wherein the primary lock further includes a wheel assembly affixed to the pawl for pivotal movement of the pawl into the locked position when the wheel assembly is in a disengaged orientation from a flat surface and for pivotal movement of the pawl into the unlocked position when the wheel assembly is in an engaged orientation with the flat surface.

9. A mud box as claimed in claim 8 wherein the wheel assembly includes an elongated axle having a wheel rotatably affixed to each end generally outwardly from the sides of the box, the axle being further positioned with the wheels generally below the bottom surface of the box in the disengaged orientation and generally in a plane with the bottom surface in the engaged orientation.

10. A mud box as claimed in claim 9 wherein the wheel assembly further includes a spring attached to the box and bearing on the wheel assembly axle to bias the pawl into the locked position with the wheel assembly in the disengaged orientation.

11. A mud box as claimed in claim 2 wherein the second arm of the pressure member has a secondary lock attached thereto, the secondary lock having an unlocked position in which the second arm of the pressure member bears against the cover and a locked position in which the second arm of the pressure member is prevented from bearing against the cover.

12. A mud box as claimed in claim 2 wherein the one end of the tension spring attached to the box is removable for opening the cover and filling and cleaning the box.

13. A mud box comprising:

a box including a bottom surface with an outlet orifice, sides, a cover pivotally attached along one edge of the box, and a handle attached to the cover for positioning the box on a surface and applying extruding pressure to the cover for ejecting material through the orifice;

first and second pressure members each including a first arm extending outwardly from a pivot axis and a second arm extending outwardly from the pivot axis at an angle to the first arm and bearing against the cover pivotally attached to the box to apply extruding pressure to the cover, the first and second pressure members being pivotally mounted on a pressure member mounting axle rotatably mounted on the box, and first and second tension springs each having first and second ends with the first end of the first and second tension springs attached to the box and the second end of the first tension spring attached to the first arm of the first pressure member and the second end of the second tension spring attached to the first arm of the second pressure member, the first and second pressure members being mounted so as to bear against the cover and apply extruding pressure to the cover in response to tension of the tension springs; and a primary lock coupled to the first and second pressure members and the box, the primary lock having a locked position in which the first and second pressure members are prevented from applying extruding pressure to the cover and an unlocked position in which the first and second pressure members apply extruding pressure to the cover.

14. A mud box as claimed in claim 13 wherein the primary lock is activated by a wheel assembly which moves the primary lock into the locked position when the box and wheel assembly are disengaged from a surface and which moves the primary lock into the unlocked position when the wheel assembly and box are engaged with a surface.

15. A mud box as claimed in claim 13 wherein the second arm of each of the first and second pressure members includes a roller attached thereto which bears against the cover.

16. A mud box as claimed in claim 13 wherein the primary lock includes a ratchet attached to the pressure member mounting axle for rotary movement with the pressure member mounting axle and a pawl pivotally affixed to the box for engaging the ratchet and preventing rotation thereof in a locked position and disengaging the ratchet and allowing rotation thereof in an unlocked position.

17. A mud box as claimed in claim 16 wherein the primary lock further includes a wheel assembly affixed to the pawl for pivotal movement of the pawl into the locked position when the wheel assembly is in a disengaged orientation from a flat surface and for pivotal movement of the pawl into the unlocked position when the wheel assembly is in an engaged orientation with the flat surface.

18. A mud box as claimed in claim 17 wherein the wheel assembly includes an elongated wheel mounting axle having a wheel rotatably affixed to each end generally outwardly from the sides of the box, the wheel mounting axle being further positioned with the wheels generally below the bottom surface of the box in the disengaged orientation and generally in a plane with the bottom surface in the engaged orientation.

19. A mud box as claimed in claim 18 wherein the wheel assembly further includes a spring attached to the box and bearing on the wheel mounting axle to bias the pawl into the locked position with the wheel assembly in the disengaged orientation.

20. A mud box as claimed in claim 18 wherein at least one of the second arms of the first and second pressure members has a secondary lock attached thereto, the secondary lock having an unlocked position in which the at least one of the second arms of the first and second pressure members bears against the cover and a locked position in which the at least one of the second arms of the first and second pressure members is prevented from bearing against the cover.

21. A mud box as claimed in claim 13 wherein the first end of each of the tension springs attached to the box is removable for filling and cleaning of the box.

22. A mud box comprising:

a box including a bottom surface with an outlet orifice, sides, a cover pivotally attached along one edge of the box, and a handle attached to the cover for positioning the box on a surface and applying extruding pressure to the cover for ejecting material through the orifice;

first and second pressure members each including a first arm extending outwardly from a pivot axis and a second arm extending outwardly from the pivot axis at an angle to the first arm and bearing against the cover pivotally attached to the box to apply extruding pressure to the cover, the first and second pressure members being pivotally mounted on a pressure member mounting axle rotatably mounted on the box, and first and second tension springs each having first and second ends with the first end of the first and second tension springs attached to the box and the second end of the first tension spring attached to the first arm of the first pressure member and the second end of the second tension spring attached to the first arm of the second pressure member, the first and second pressure members being mounted so as to bear against the cover and apply extruding pressure to the cover in response to tension of the tension springs; and a primary lock coupled to the first and second pressure members and the box, the primary lock having a locked position in which the first and second pressure members are prevented from applying extruding pressure to the cover and an unlocked position in which the first and second pressure members apply extruding pressure to the cover, the primary lock including a ratchet attached to the pressure member mounting axle for rotary movement with the pressure member mounting axle and a pawl pivotally affixed to the box for engaging the ratchet and preventing rotation thereof in the locked position and disengaging the ratchet and allowing rotation thereof in the unlocked position, the primary lock further including a wheel assembly affixed to the pawl for pivotal movement of the pawl into the locked position when the wheel assembly is in a disengaged orientation from a flat surface and for pivotal movement of the pawl into the unlocked position when the wheel assembly is in an engaged orientation with the flat surface, the wheel assembly including an elongated wheel mounting axle having a wheel rotatably affixed to each end generally outwardly from the sides of the box, the wheel mounting axle being further positioned with the wheels generally below the bottom surface of the box in the disengaged orientation and generally in a plane with the bottom surface in the engaged orientation, and the wheel assembly further including a spring attached to the box and bearing on the wheel mounting axle to bias the pawl into the first position with the wheel assembly in the disengaged orientation.

* * * * *